US010011457B2

(12) United States Patent
Meneghini

(10) Patent No.: US 10,011,457 B2
(45) Date of Patent: Jul. 3, 2018

(54) DEVICE FOR RETAINING A SLEEVE AROUND A MANDREL

(71) Applicant: Cockerill Maintenance & Ingenierie S.A., Seraing (BE)

(72) Inventor: Angelo Meneghini, Seraing (BE)

(73) Assignee: Cockerill Maintenance & Ingénierie S.A., Seraing (BE)

( * ) Notice: Subject to any disclaimer, the term of this patent is extended or adjusted under 35 U.S.C. 154(b) by 317 days.

(21) Appl. No.: 14/766,074

(22) PCT Filed: Jan. 23, 2014

(86) PCT No.: PCT/EP2014/051303

§ 371 (c)(1),
(2) Date: Aug. 5, 2015

(87) PCT Pub. No.: WO2014/122025

PCT Pub. Date: Aug. 14, 2014

(65) Prior Publication Data

US 2015/0368066 A1 Dec. 24, 2015

(30) Foreign Application Priority Data

Feb. 5, 2013 (BE) ..... 2013/0076

(51) Int. Cl.
*B65H 75/24* (2006.01)
*B21C 47/30* (2006.01)

(52) U.S. Cl.
CPC ..... *B65H 75/242* (2013.01); *B21C 47/30* (2013.01); *B65H 2301/41852* (2013.01)

(58) Field of Classification Search
CPC ..... B65H 75/242; B65H 2301/41852; B21C 47/04; B21C 47/24; B21C 47/245; B21C 47/30
See application file for complete search history.

(56) References Cited

U.S. PATENT DOCUMENTS 1,859,117 A * 5/1932 Thomas ..... B21C 47/30 242/571.6
1,905,178 A * 4/1933 Kohler ..... B21C 47/30 242/571.6

(Continued)

FOREIGN PATENT DOCUMENTS

CA 1247586 A 12/1988
EP 0002652 A1 7/1979

(Continued)

*Primary Examiner* — William A. Rivera
(74) *Attorney, Agent, or Firm* — Reinhart Boerner Van Deuren P.C.

(57) ABSTRACT

The present invention relates to a mandrel comprising a radially movable portion (6, 8) and a retaining device for a sleeve (7) having an annular cross-section. Said device comprises a mounting (14), inserted in or built into the mandrel, and a retaining tab (1) pivotably mounted around an axis (3) that is in a direction parallel to the axis of the mandrel and onto said mounting (14). Said retaining tab (1) is designed to be, during use, pivotable from a first position, in which said retaining tab covers a portion of the annular surface of the sleeve (7), toward a second position, in which said retaining tab releases the annular surface of the sleeve (7). The pivotal movement from the first position toward the second position, or vice versa, is, during use, automatically actuated by radially moving the movable portion (6, 8) of the mandrel.

13 Claims, 2 Drawing Sheets

(56) References Cited

U.S. PATENT DOCUMENTS

| | | | | | |
|---|---|---|---|---|---|
| 1,905,192 | A * | 4/1933 | Talbot | B21C 47/30 | 242/575.4 |
| 2,219,818 | A * | 10/1940 | O'Brien | B21C 47/30 | 242/575.4 |
| 2,382,672 | A * | 8/1945 | Shook | B29D 30/48 | 156/419 |
| 2,682,924 | A * | 7/1954 | Maquat | B26D 3/003 | 242/574.1 |
| 2,723,086 | A * | 11/1955 | Russell | B21C 47/323 | 242/575.4 |
| 2,973,160 | A * | 2/1961 | Zernov | B65H 75/242 | 242/575.5 |
| 3,281,092 | A * | 10/1966 | Schultz | B65H 75/242 | 242/571.5 |
| 3,335,971 | A * | 8/1967 | Richter | D01H 7/16 | 242/571.6 |
| 3,565,360 | A | 2/1971 | Ura | | |
| 3,815,839 | A * | 6/1974 | Madachy | B21C 47/30 | 242/571.1 |
| RE28,296 | E * | 1/1975 | Mallette | G11B 15/662 | 242/573.9 |
| 4,073,497 | A * | 2/1978 | Flagg | B23B 31/40 | 242/599.2 |
| 4,447,016 | A * | 5/1984 | Enberg | B21C 47/006 | 192/48.601 |
| 5,645,247 | A | 7/1997 | Voigt | | |
| 2004/0232272 | A1 * | 11/2004 | Leisten | B21C 47/04 | 242/598.1 |

FOREIGN PATENT DOCUMENTS

| | | | |
|---|---|---|---|
| EP | 0142794 | A2 | 11/1984 |
| EP | 0987589 | A1 | 3/2000 |
| EP | 1564014 | A2 | 8/2005 |
| JP | H01-83754 | U | 6/1989 |
| JP | H0183753 | U | 6/1989 |
| JP | H02110055 | A | 4/1990 |
| JP | 2000000613 | A | 1/2000 |
| JP | 2000255638 | A | 9/2000 |
| JP | 2005014091 | A | 1/2005 |
| JP | 2008229707 | A | 10/2008 |

* cited by examiner

DEVICE FOR RETAINING A SLEEVE AROUND A MANDREL

FIELD OF THE INVENTION

The present invention relates to a device for retaining a sleeve positioned around an expandable mandrel. It more particularly relates to a device for retaining an elastic sleeve placed around an expandable mandrel designed to be driven to wind and unwind coils. More specifically, this sleeve-retaining device is applicable on finishing lines for the continuous treatment of metal strips.

The invention also relates to a mandrel comprising the aforementioned retaining device.

It further relates to a method for automatically moving means serving to retain the sleeve.

BACKGROUND OF THE INVENTION

In metallurgy, it is known to wind and unwind metal strips on expandable mandrels. During unwinding and winding, the mandrel is expanded, whereas it must be shrunk to allow easy placement of the coil in the unwinder or easy removal of the coil from the winder.

To avoid marking inner turns of the coil during winding, an elastic sleeve is generally placed on the mandrel. Such sleeves are described in documents JP 2008229707, JP 2005014091 and JP 11057853.

The elastic sleeve must be able to follow the movements of the mandrel while remaining rigidly secured thereto when the coil is removed from the mandrel. To that end, it is common practice to provide a retaining device for the elastic sleeve. This device must prevent the elastic sleeve from being removed from the mandrel with the coil. This device is typically fastened by screws or other similar means. Thus, in document JP 2000000613, the retaining device is fastened using quarter-turn screws.

The elastic sleeves have a limited lifetime and must consequently be replaced periodically. It is also necessary to change the sleeve when the diameter of the eye of the coil varies.

Before the sleeve is removed, the mandrel must be fully retracted. The operator must stand in front of the mandrel, unscrew the retaining device and remove it. This operation is dangerous, since many machines work automatically in this location. It is then necessary for the operator to electrically, hydraulically, mechanically and pneumatically log the machines around the mandrel during the assembly and disassembly of the retaining device for the elastic sleeve. Then and only then, the sleeve can be disassembled and a new sleeve can be inserted on the mandrel with the necessary equipment for that unlogged operation. After the sleeve is placed, the operator must once again fasten the retaining device and, consequently, once again log all the machines in the surrounding area. All of these operations result in considerable lost time, which will be even greater if a handling machine for removing and placing the sleeve on the mandrel is also installed.

AIMS OF THE INVENTION

The present invention aims to provide a device for retaining the sleeve allowing to accelerate the process of changing the sleeve while avoiding the operator having to enter a dangerous zone.

BRIEF DESCRIPTION OF THE INVENTION

The present invention relates to a mandrel comprising a radially movable part and a retaining device for a sleeve having an annular cross-section, said device comprising a support attached to or integrated into the mandrel and a retaining tab pivotably mounted around an axis in a direction that is parallel to the axis of the mandrel and on said support, said retaining tab being designed to be able, during use, to pivot from a first position where it covers a portion of the annular surface of the sleeve toward a second position where it releases the annular surface of the sleeve, the pivoting from the first position to the second position or vice versa being, during use, automatically actuated by the radial movement of the moving part of the mandrel.

According to specific embodiments of the invention, the mandrel comprises at least one or a suitable combination of the following features:

- the retaining device comprises a push spring designed to keep the retaining tab in the first position;
- the retaining tab comprises a recess and a slot;
- the retaining device comprises two or three retaining tabs;
- the push spring is dimensioned to keep the retaining tab in the first position when the mandrel is fully expanded or partially expanded;
- it comprises a finger positioned on the radially movable part, said finger being able to cooperate, during use, with the recess formed in the retaining tab, said cooperation allowing to move the retaining tab from the first position to the second position when the mandrel retracts from an expanded or semi-expanded position toward a completely shrunk position;
- the recess of the retaining tab is larger than the finger, such that the retraction of the mandrel from an expanded position to a semi-expanded position does not cause the retaining tab to move;
- the support comprises a stop that is able to cooperate, during use, with the slot of the retaining tab, the slot being dimensioned to delimit the movement of the retaining tab between the first position and the second position;
- the support is attached to one axial end of the mandrel using screws, pins and a key.

The present invention also relates to an assembly comprising a mandrel as described above and an elastic sleeve with an annular cross-section placed around said mandrel.

Lastly, the present invention relates to a method for the automatic movement of the retaining device comprised in the assembly of the mandrel and sleeve above, comprising the following steps:

- radial movement of the movable part of the mandrel toward an expanded or semi-expanded position driving the automatic positioning of the retaining tab in front of a portion of the annular surface of the sleeve,
- radial movement of the movable part of the mandrel toward a completely shrunk position driving the automatic movement of the retaining tab outside the annular surface of the sleeve.

According to specific embodiments of the invention, the method comprises at least one or a suitable combination of the following features:

- the spring keeps the retaining tab in front of a portion of the annular surface of the sleeve when the movable part of the mandrel is in the expanded or semi-expanded position;
- the finger secured to the movable part of the mandrel bears on an inner wall of the recess formed in the retaining tab and thereby drives the movement of the retaining tab outside the annular surface of the sleeve during the radial movement of the movable part of the mandrel toward the completely shrunk position.

BRIEF DESCRIPTION OF THE DRAWINGS

FIG. 1(*b*) shows the mandrel retracted in an intermediate position for removing or placing the coil on the mandrel, the elastic sleeve being kept in position using completely deployed retaining tabs;

FIG. 1(*c*) shows the position of the mandrel completely retracted with the retaining tabs of the sleeve retracted for removing or placing an elastic sleeve.

FIGS. 2(*a*) (*b*) (*c*) respectively show the same positions of the mandrel as those of FIG. 1.

Figure 1:
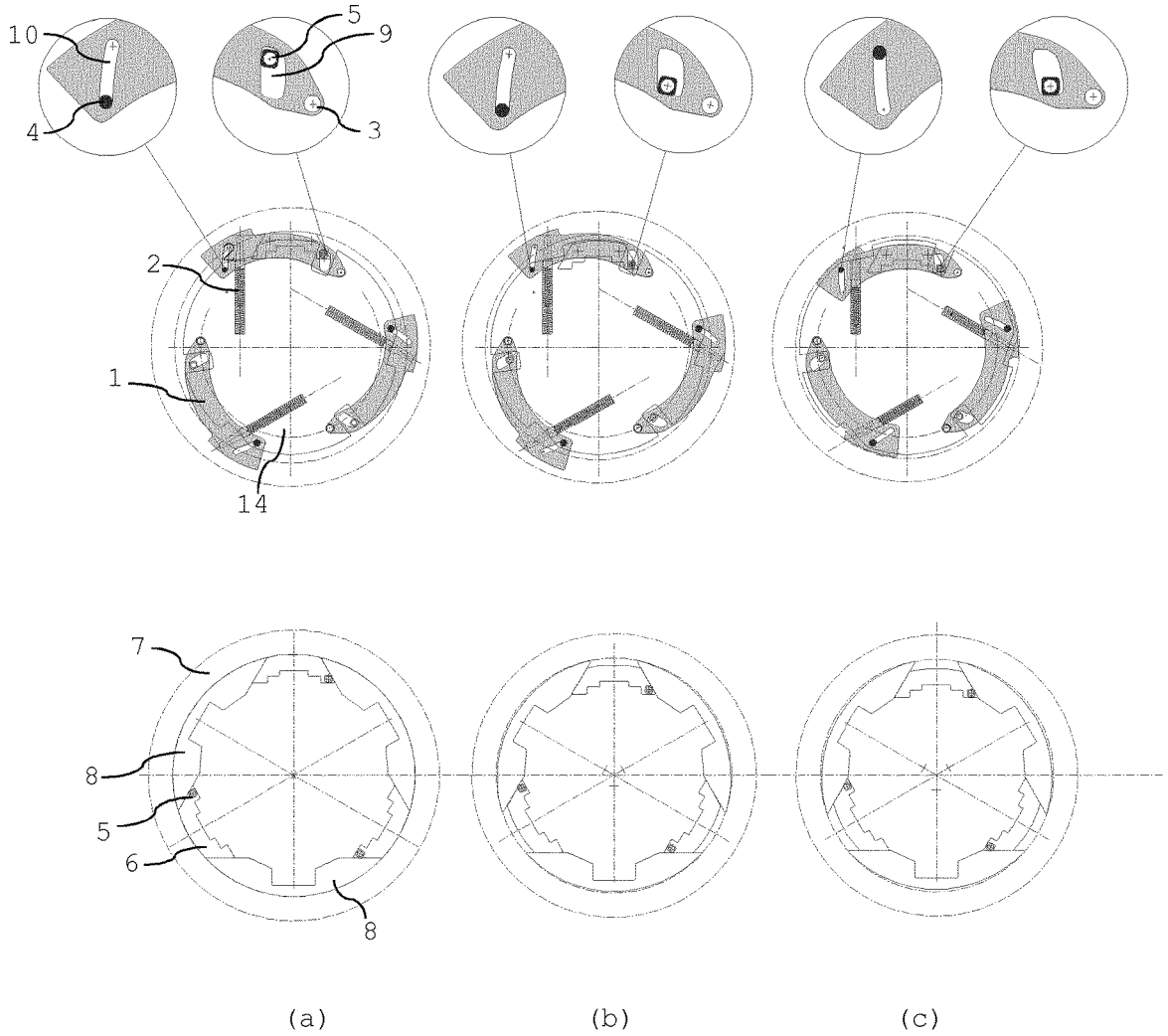
In FIG. 1, the top part shows the retaining device according to the invention that is integrated into a mandrel of the closed type, and the bottom part shows the corresponding expansion positions of the mandrel. More specifically, FIG. 1(*a*) shows the fully expanded position of the mandrel for winding or unwinding the coil on the mandrel, the elastic sleeve being kept in position using completely deployed retaining tabs.

KEY (1) Retaining tab of the sleeve
(2) Push spring that allows to keep the retaining tab in the deployed position
(3) Rotation axis of the retaining tab
(4) Mechanical stop allowing to limit the travel of the retaining tab in the deployed position
(5) Finger secured to the expansion and retraction movement of the mandrel
(6) Corner of the mandrel
(7) Elastic sleeve
(8) Segment of the mandrel
(9) Recess in the retaining tab
(10) Slot in the retaining tab
(11) Centering pin of the support
(12) Fastening screw of the mechanism
(13) Positioning key of the support
(14) Support

DETAILED DESCRIPTION OF THE INVENTION

The present invention relates to a sleeve-retaining device that is automatically retractable in order to accelerate the process of changing the sleeve and to avoid the operator having to enter a dangerous zone.

The sleeve-retaining device according to the invention may be applied to radial expansion mandrels with different types of construction. For mandrels described as the closed type, because they are tight in order to contain the oil necessary for lubrication, the device may be integrated into the closing piece of the mandrel. From mandrels of the open type, i.e., not tight, which are greased, the support of the device may be attached to the mandrel. These different types of mandrel comprise radially movable parts ensuring the retraction and expansion of the mandrel during use.

During use, the expandable mandrel may move radially between three key positions: a completely expanded position, a semi-expanded position and a completely shrunk position. The mandrel is completely expanded during the winding or unwinding of the strip. The mandrel is semi-expanded when the coil is slipped on the unwinder and when the coil is removed from the winder. Lastly, the mandrel is completely shrunk when the sleeve must be replaced.

To allow the removal of the sleeve when the mandrel is completely retracted, the retaining device of the elastic sleeve must be retracted. However, it must be deployed to keep the sleeve on the mandrel during the removal or placement of the coil.

Figure 2:
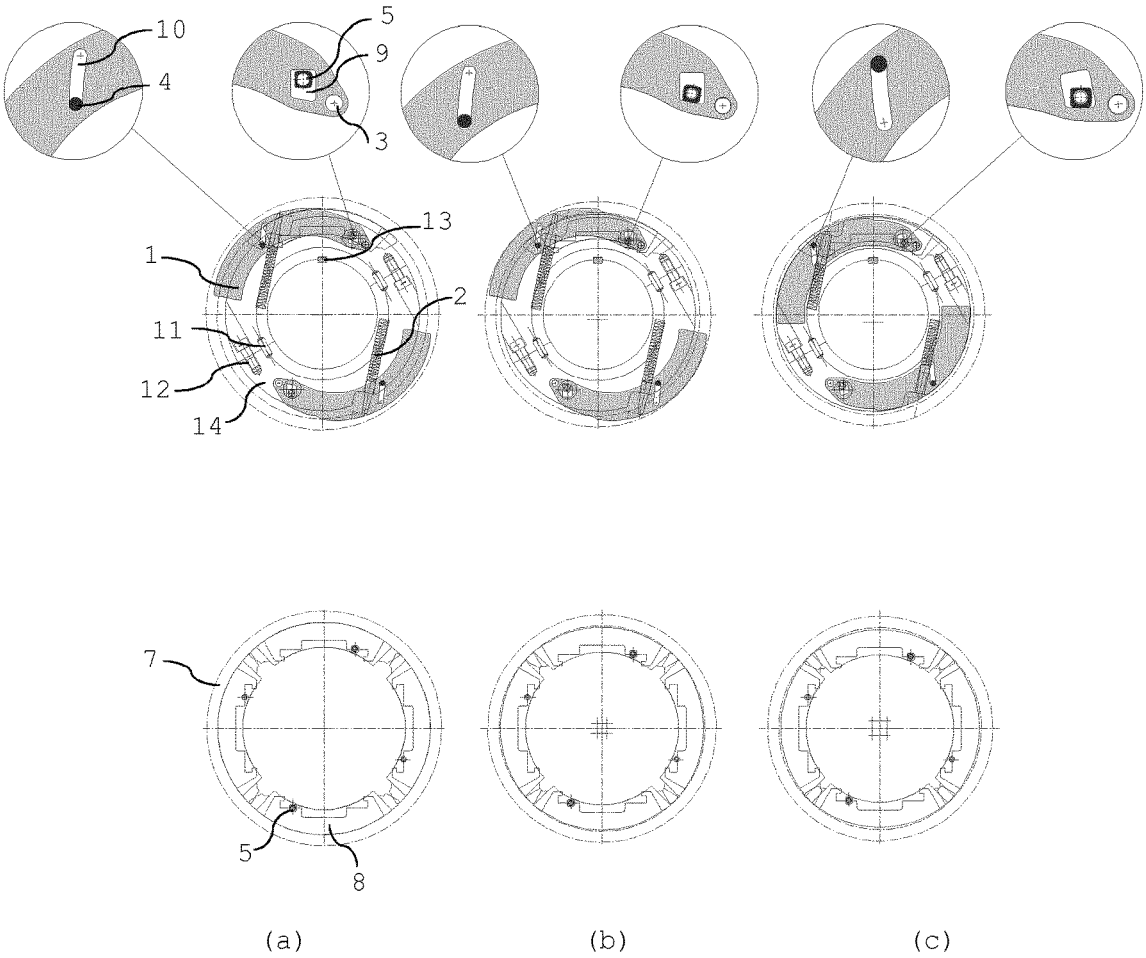
In FIG. 2, the top part shows the retaining device according to the invention attached to a mandrel of the open type, and the bottom part shows the corresponding expansion positions of the mandrel.

The device according to the invention is shown in FIGS. 1 and 2 for a closed-type mandrel and for an open-type mandrel, respectively.

An elastic sleeve 7 with an annular cross-section is positioned around the expandable mandrel. The device according to the invention comprises a retaining tab 1 mounted on a support 14 at one axial end of the mandrel. There are two possible configurations. In one, the retaining device is integrated into the mandrel, that construction being favored when the mandrel is of the closed type. In that case, the support 14 of the retaining tab 1 is the closing piece of the mandrel (FIG. 1). In the other, the retaining device is mounted on an external support 14 to be attached to the mandrel (FIG. 2), that construction being favored when the mandrel is of the open type.

The pivot axis 3 of the retaining tab 1 has a direction that is parallel to the axis of the sleeve. Thus, the retaining tab 1 moves across from the annular cross-section of the sleeve 7. The retaining tab can adopt two working positions. In a first position, it is kept in the deployed position using a push spring 2. In that position, the retaining tab hinders the axial movement of the sleeve (FIGS. 1-2(*a*) and (*b*)). In a second position, the push spring 2 is compressed for reasons explained below, and the retaining tab 1 is consequently retracted, then no longer hindering the axial movement of the sleeve 7 (FIGS. 1-2(*c*)).

According to the invention, the movement of the retaining tab is related to the movement of the mandrel parts that are radially movable. To that end, a finger 5 fastened to a moving part of the mandrel co-operates with a recess 9 formed in the retaining tab 1. In the case of a closed mandrel (FIG. 1), the moving part is a corner 6 positioned between two segments 8 of the mandrel and, in the case of an open mandrel (FIG. 2), the radially movable part is a segment 8 of the mandrel.

The retaining tab 1 is kept in a same deployed position under the action of the push spring 2 with the mandrel is semi-expanded or expanded. To that end, the recess 9 formed in the retaining tab 1 is larger than the finger 5 of the mandrel and dimensioned so that the movement of the finger 5 within the recess 9 does not cause any movement of the retaining tab 1 when the moving pieces of the mandrel move from their completely expanded position toward their semi-expanded position. In this scenario, the finger 5 does not apply force on the wall of the recess 9 to compress the push spring 2 (FIG. 1-2(*a*)(*b*)). However, during the movement of the moving parts of the mandrel from a semi-expanded position to a shrunk position, the finger 1 bears on the wall of the recess 9 close to the axis of the mandrel and applies sufficient force on the retaining tab 1 to compress the spring 2 (FIG. 1-2(*c*)).

The retaining tab 1 is further provided with a slot 10 cooperating with a stop 4 secured to the support 14 so as to limit the movement of the retaining tab 1 in the deployed position. The slot 10 and the stop 4 are dimensioned to prevent the retaining tab 1 from protruding past the outer diameter of the sleeve. The stop 4 also allows to keep the retaining tab 1 in place despite the centrifugal forces.

As already mentioned, the sleeve-retaining device can be integrated into or attached to the mandrel. In the latter case illustrated in FIG. 2, the support 14 is attached to the open-type mandrel using fastening elements consisting of pins 11, screws 12 and key 13.

The retaining device being able to be attached, the present invention protects the retaining device alone as well as a mandrel comprising the retaining device, irrespective of whether the latter is integrated or attached.

The present invention is illustrated in FIGS. 1 and 2 for a retaining device for the sleeve comprising several retaining tabs 1. For example, two or three retaining tabs can be distributed on the annular surface of the sleeve.

Advantages of the Invention

The device for retaining the sleeve according to the invention is configured not to hinder the manipulation of the coil.

It is located on the rotating mandrel and withstands the centrifugal forces that it generates owing to the cooperation of the stop 4 and the slot 10 in the retaining tab 1.

Lastly, the device according to the invention is compatible for sleeves with different diameters, for example 508 and 610 mm.

The sleeve-retaining device may be applied to mandrels with different types of construction.

The invention claimed is:

1. A mandrel comprising a radially movable part (6, 8) and a retaining device for a sleeve having an annular cross-section (7), said device comprising a support (14) attached to or integrated into the mandrel and a retaining tab (1) pivotably mounted around an axis (3) in a direction parallel to the axis of the mandrel and on said support (14), said retaining tab (1) being designed to be able, during use, to pivot from a first position where it covers a portion of the annular surface of the sleeve (7) toward a second position where it releases the annular surface of the sleeve (7), the pivoting from the first position to the second position or vice versa being, during use, automatically actuated by the radial movement of the radial moveable part (6, 8) of the mandrel;

wherein the retaining device comprises a push spring (2) designed to keep the retaining tab (1) in the first position.

2. The mandrel according to claim 1, wherein the retaining tab (1) comprises a recess (9) and a slot (10).

3. The mandrel according to claim 1, wherein the retaining device comprises two retaining tabs (1).

4. The mandrel according to claim 1, wherein the push spring (2) is dimensioned to keep the retaining tab (1) in the first position when the mandrel is completely or partially expanded.

5. The mandrel according to claim 1, comprising a finger (5) positioned on the radially movable part (6, 8), said finger (5) being able to cooperate, during use, with the recess (9) formed in the retaining tab (1), said cooperation allowing to move the retaining tab (1) from the first position to the second position when the mandrel retracts from an expanded or semi-expanded position toward a completely shrunk position.

6. The mandrel according to claim 5, wherein the recess (9) of the retaining tab (1) is larger than the finger (5), such that the retraction of the mandrel from an expanded position to a semi-expanded position does not cause the retaining tab to move (1).

7. The mandrel according to claim 1, wherein the support (14) is attached to one axial end of the mandrel using screws (12), pins (11) and a key (13).

8. An assembly comprising a mandrel according to claim 1, and an elastic sleeve (7) having an annular cross-section placed around said mandrel.

9. The mandrel according to claim 1, wherein the retaining device comprises three retaining tabs (1).

10. The mandrel according to claim 1, wherein the support (14) comprises a stop (4) that is able to cooperate, during use, with the slot (10) of the retaining tab (1), the slot (10) being dimensioned to delimit the movement of the retaining tab (1) between the first position and the second position.

11. A mandrel comprising a radially movable part (6, 8) and a retaining device for a sleeve having an annular cross-section (7), said device comprising a support (14) attached to or integrated into the mandrel and a retaining tab (1) pivotably mounted around an axis (3) in a direction parallel to the axis of the mandrel and on said support (14), said retaining tab (1) being designed to be able, during use, to pivot from a first position where it covers a portion of the annular surface of the sleeve (7) toward a second position where it releases the annular surface of the sleeve (7), the pivoting from the first position to the second position or vice versa being, during use, automatically actuated by the radial movement of the radial moveable part (6, 8) of the mandrel;

wherein the support (14) comprises a stop (4) that is able to cooperate, during use, with the slot (10) of the retaining tab (1), the slot (10) being dimensioned to delimit the movement of the retaining tab (1) between the first position and the second position.

12. A method for automatically moving the retaining device comprised in the assembly according to claim 8, comprising the following steps:

radially moving the movable part (6, 8) of the mandrel toward an expanded or semi-expanded position driving the automatic positioning of the retaining tab (1) in front of a portion of the annular surface of the sleeve (7), radially moving the movable part (6, 8) of the mandrel toward a completely shrunk position driving the automatic movement of the retaining tab (1) outside the annular surface of the sleeve (7);

wherein a spring (2) keeps the retaining tab (1) in front of a portion of the annular surface of the sleeve (7) when the movable part (6, 8) of the mandrel is in the expanded or semi-expanded position.

13. The method according to claim 12, wherein a finger (5) secured to the movable part (6, 8) of the mandrel bears on an inner wall of a recess (9) formed in the retaining tab (1) and thereby drives the movement of the retaining tab (1) outside the annular surface of the sleeve (7) during the radial movement of the movable part (6, 8) of the mandrel toward the completely shrunk position.

* * * * *